US011510547B2

(12) United States Patent
Oznazli et al.

(10) Patent No.: US 11,510,547 B2
(45) Date of Patent: Nov. 29, 2022

(54) SPRINKLER DEVICE FOR DISHWASHERS

(71) Applicant: VESTEL BEYAZ ESYA SANAYI VE TICARET ANONIM SIRKETI, Manisa (TR)

(72) Inventors: Gurkan Oznazli, Manisa (TR); Halil Sayir, Manisa (TR)

(73) Assignee: VESTEL BEYAZ ESYA SANAYI VE TICARET ANONIM SIRKETI, Manisa (TR)

( * ) Notice: Subject to any disclaimer, the term of this patent is extended or adjusted under 35 U.S.C. 154(b) by 67 days.

(21) Appl. No.: 17/206,561

(22) Filed: Mar. 19, 2021

(65) Prior Publication Data

US 2021/0290031 A1 Sep. 23, 2021

(30) Foreign Application Priority Data

Mar. 19, 2020 (TR) ..... 2020/04325

(51) Int. Cl.
*A47L 15/23* (2006.01)
*A47L 15/42* (2006.01)

(52) U.S. Cl.
CPC ..... *A47L 15/23* (2013.01); *A47L 15/4278* (2013.01); *A47L 15/4282* (2013.01)

(58) Field of Classification Search
None
See application file for complete search history.

(56) References Cited

U.S. PATENT DOCUMENTS 5,842,492 A 12/1998 Lee

*Primary Examiner* — Levon J Shahinian
(74) *Attorney, Agent, or Firm* — Dennemeyer & Associates; Steven M. Shape

(57) ABSTRACT

A sprinkler device (T) according to the present invention which is suitable for use in a dishwasher (B) comprising a cleaning chamber (B1), for spraying a cleaning fluid onto the dishes by positioning it to rotate about a first axis (E1) comprises a carrier body (T1) which is rotatable about the first axis (E1); a fixed arm (T2) which is located on the carrier body (T1), which is fixed relative to the carrier body (T1) and rotatable with the carrier body (T1), which has a one hole (P) thereon, and through which the cleaning fluid is sprayed on the dishes through the hole (P) to thus rotate the carrier body (T1); a movable arm (T3) which is connected with an edge of the carrier body (T1), a part of which passes through an opening on the edge of the carrier body (T1) and projects from the carrier body (T1), which has a hole (P) thereon, which allows the carrier body (T1) to rotate about the first axis (E1) by spraying, through the hole (P), the cleaning fluid passing therethrough by means of a passage opening on its side facing the carrier bod (T1), which is movable towards the center of the carrier body (T1); a movement mechanism located outside the carrier body (T1), which enables said movement of the movable arm (T3) by means of the rotational movement of the carrier body (T1); and a transmission mechanism which transmits the movement received from the movement mechanism to the movable arm (T3).

15 Claims, 6 Drawing Sheets

SPRINKLER DEVICE FOR DISHWASHERS

CROSS-REFERENCE TO RELATED APPLICATIONS

This application claims priority to Turkish application 2020/04325, filed Mar. 19, 2020, which is hereby incorporated by reference in its entirety.

FIELD OF THE INVENTION

The present invention relates to sprinkler devices in dishwashers for supplying a cleaning fluid onto the dishes.

BACKGROUND ART

In particular, dishwashers are widely used to wash and clean kitchen utensils such as plates, bowls, glasses, cutlery and pots. Conventional dishwashers comprise a cleaning chamber in which these dirty kitchen utensils, i.e., dishes, are cleaned. The dishes are placed in the cleaning chamber by means of a basket, which basket has a perforated structure (preferably a wire mesh) to allow a cleaning fluid (e.g., water and/or water containing a cleaning agent such as detergent, rinse aid) to reach the dishes thereon. The cleaning fluid allowing the washing and/or rinsing of the dishes is transmitted to the dishes on the basket by means of a sprinkler device that can rotate about an axis, and the washing fluid sprayed from the sprinkler device reaches the dishes so that the cleaning processes of the dishes are carried out.

Said sprinkler device comprises at least one (preferably at least two) spray arm on which at least one angular nozzle is located, and the spray arm causes the sprinkler device to rotate about an axis by the action of the water exiting the angular nozzle (water jet). With the rotation of the sprinkler device, cleaning fluid can be sprayed into a greater part of the cleaning chamber. However, especially in dishwashers with cleaning chambers of rectangular cross-section, cleaning fluid cannot be supplied effectively to the corners of the cleaning chamber, and the dishes positioned on the basket, close to the corners, cannot be cleaned effectively. In order to solve the said problem, sprinkler devices comprising a spray arm that is extended in the corners and shortened in the edges are available in the known art, and an example of such sprinkler devices is disclosed in U.S. Pat. No. 5,842,492A. In an embodiment described therein, there is a line of movement that is formed to extend towards the corners of the cleaning chamber, and the sprinkler arm has a telescopic connection with this line. When the sprinkler arm approaches the corners, it extends towards the corners by means of a coupling piece embedded in the line of movement, and gets shorter when moving away from the corners. In this way, it is possible to ensure that the cleaning fluid reaches all areas in the cleaning chamber more effectively. However, the use of the movement line requires extra space in the cleaning chamber, thus complicating the production process and reducing the usage volume of the machine.

SUMMARY OF THE INVENTION

A sprinkler device according to the present invention, which is suitable for use in a dishwasher comprising at least one cleaning chamber in which the dishes are positioned by means of a basket, for spraying a cleaning fluid onto the said dishes by positioning it to rotate about a first axis in a plane parallel to the bottom of the basket, comprises at least one carrier body in the form of a chamber, which is rotatable about the said first axis; at least one fixed arm which is located on the carrier body, which is fixed relative to the carrier body and rotatable with carrier body, which has at least one hole thereon, and through which the cleaning fluid coming from a fluid line in the dishwasher is sprayed on the dishes through the said hole to thus rotate the carrier body; at least one movable arm which is connected with an edge of the carrier body, at least a part of which passes through at least one opening on the said edge of the carrier body and projects from the carrier body, which has at least one hole thereon, which allows the carrier body to rotate about the said first axis by spraying, through the said hole, the cleaning fluid passing therethrough by means of at least one passage opening on its side facing the carrier body, which is movable towards the center of the carrier body and away from the center, which can move backward to a closed position, and forward to an open position; at least one movement mechanism located outside the carrier body, which is triggered and moved by the said rotational movement of the carrier body, thereby enabling said movement of the movable arm; and at least one transmission mechanism that transmits the movement received from the movement mechanism to the movable arm.

With the sprinkler device of the present invention, the cleaning fluid can be effectively supplied to a large part of the interior volume of the cleaning chamber, and the dishes can be cleaned more effectively and more efficiently. In addition, the movable arm, which can be extended and shortened, is moved without using external energy such as electricity, and with the positioning of the movement mechanism that performs this movement outside the carrier body, costs can be reduced along with the maintenance and technical service times. Thus, a sprinkler device can be obtained which has a low production cost, is easy to use, practical and reliable.

OBJECT OF THE INVENTION

An object of the present invention is to provide a sprinkler device enabling that a cleaning fluid is effectively supplied onto the dishes placed in a cleaning chamber of the dishwasher.

Another object of the present invention is to provide a sprinkler device having a spray arm that lengthens as it approaches the corners of the said cleaning chamber and gets shorter when the corner is passed.

Another object of the present invention is to provide a sprinkler device with a spray arm that can be lengthened and shortened without the need for an extra space in the cleaning chamber.

Another object of the present invention is to provide a sprinkler device in which the spray arm is prevented from getting stuck in its position after it is extended.

Another object of the present invention is to provide a sprinkler device in which the length of the spray arm can be changed without reducing the usage volume in the cleaning chamber.

Still another object of the present invention is to provide a sprinkler device having a low production cost, and being easy to use, practical and reliable.

DESCRIPTION OF THE DRAWINGS

Embodiments of a sprinkler device according to the present invention are illustrated in the accompanying drawings, in which.

Figure 1:
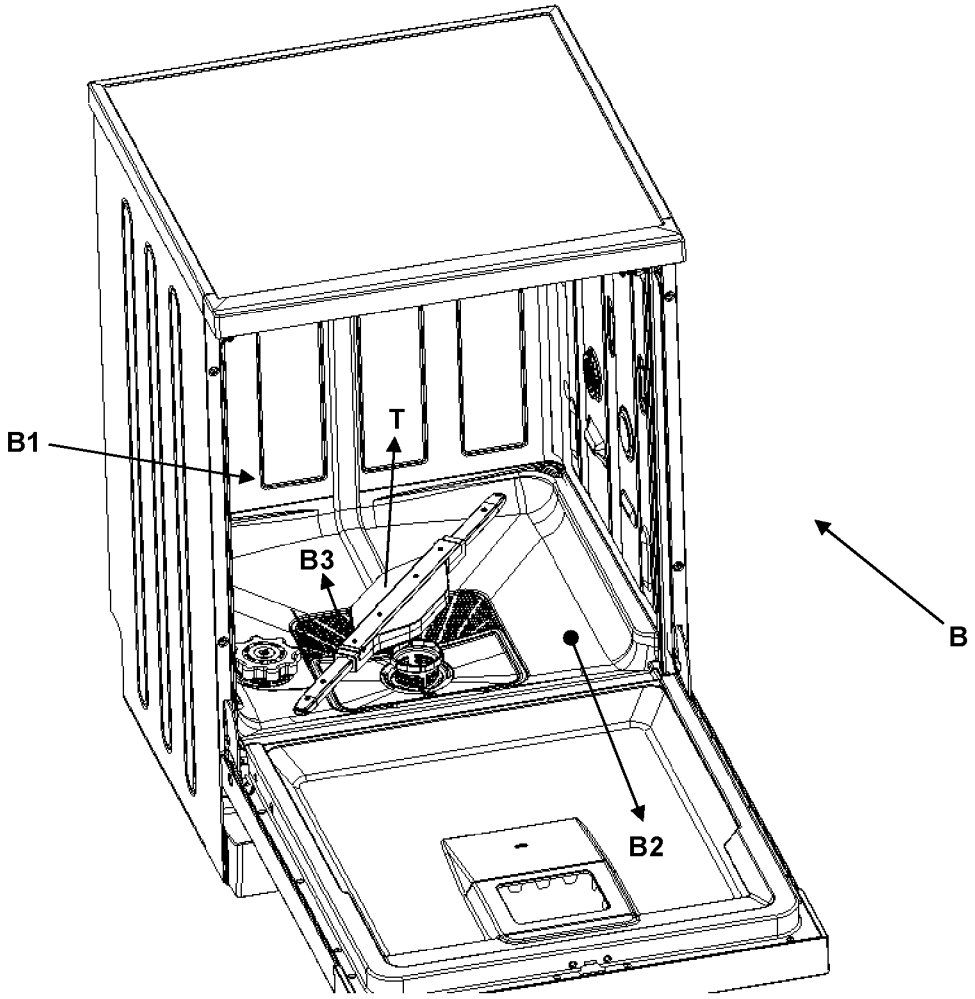
FIG. 1 is a perspective view of a dishwasher including a sprinkler device according to the present invention.
Figure 2:
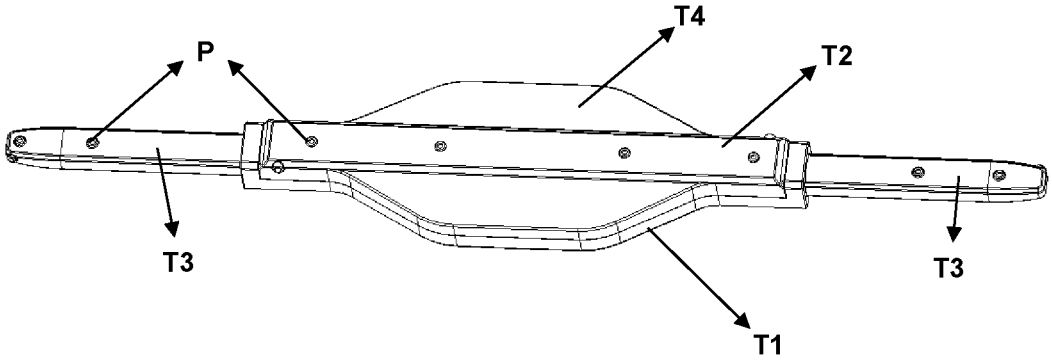
FIG. 2 is a top perspective view of the sprinkler device.
Figure 3:
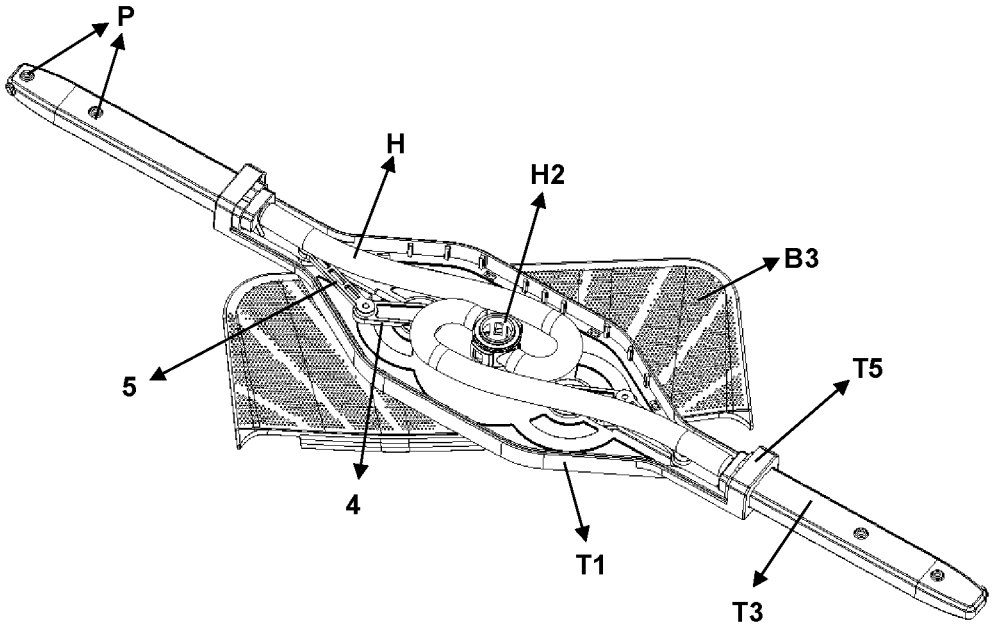
FIG. 3 is a top perspective view of a semi-assembled state of the sprinkler device.
Figure 4:
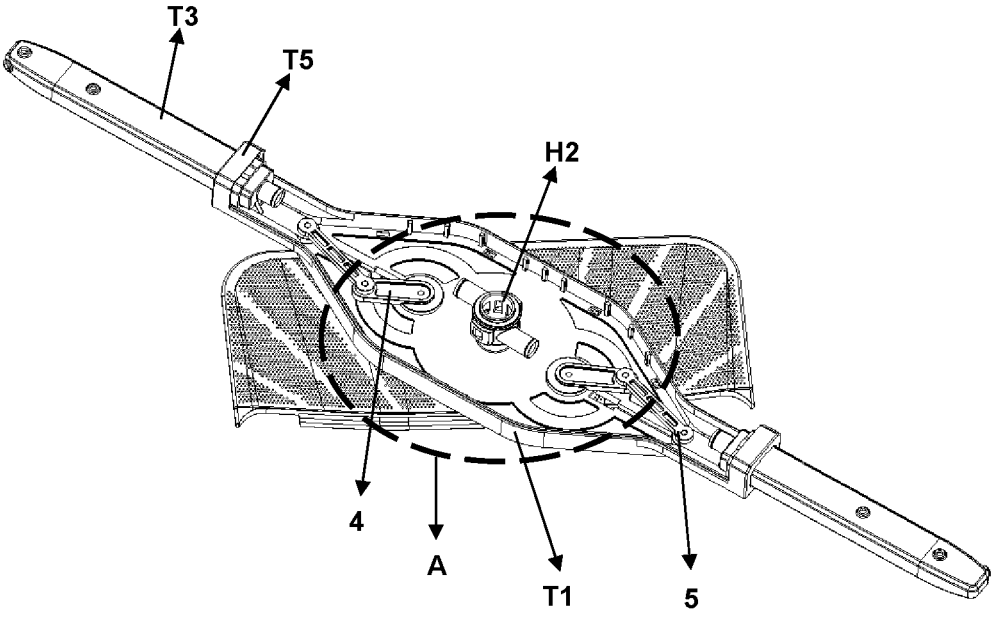
FIG. 4 is another top perspective view of a semi-assembled state of the sprinkler device.
Figure 5:
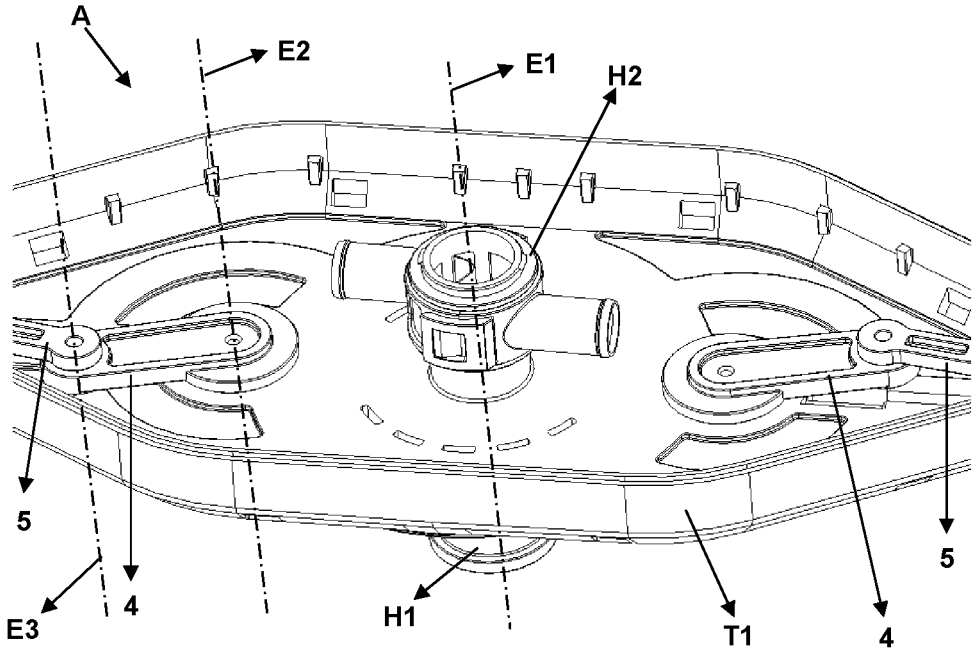
FIG. 5 is a perspective view of a detail "A" in FIG. 4.
Figure 6:
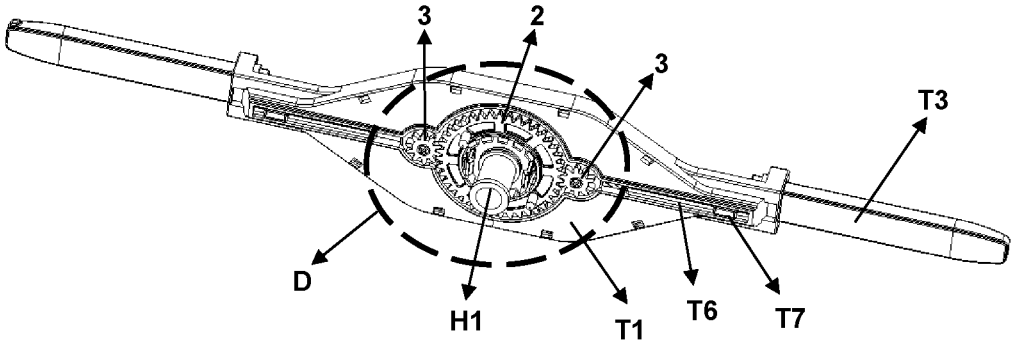
FIG. 6 is a bottom perspective view of a semi-assembled state of the sprinkler device.
Figure 7:
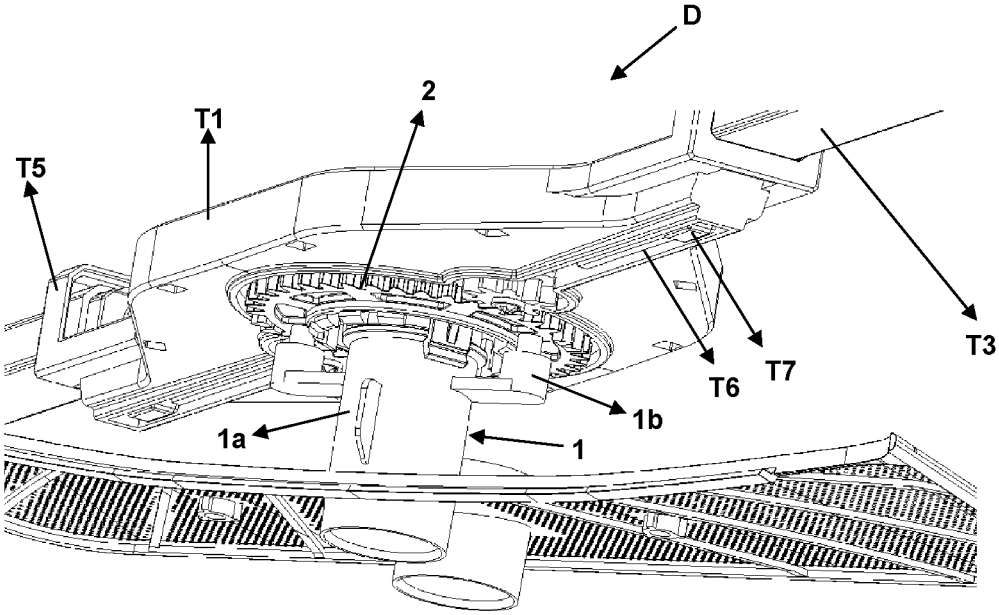
FIG. 7 is a perspective view of a detail "D" in FIG. 6, being semi-assembled to the dishwasher.
Figure 8:
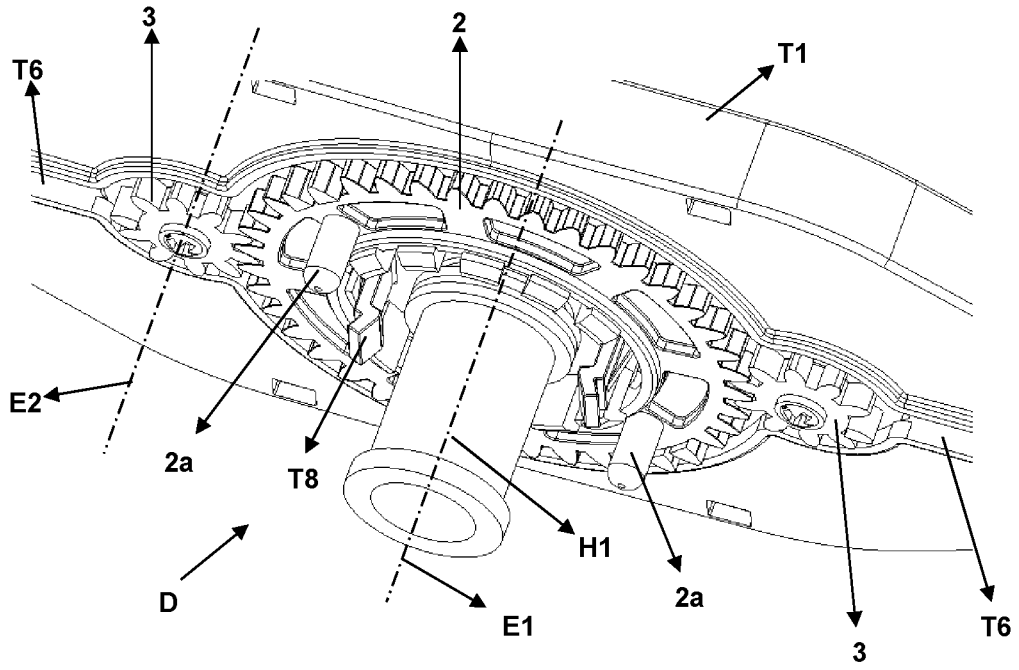
FIG. 8 is a perspective view of the detail "D" in FIG. 6.
Figure 9:
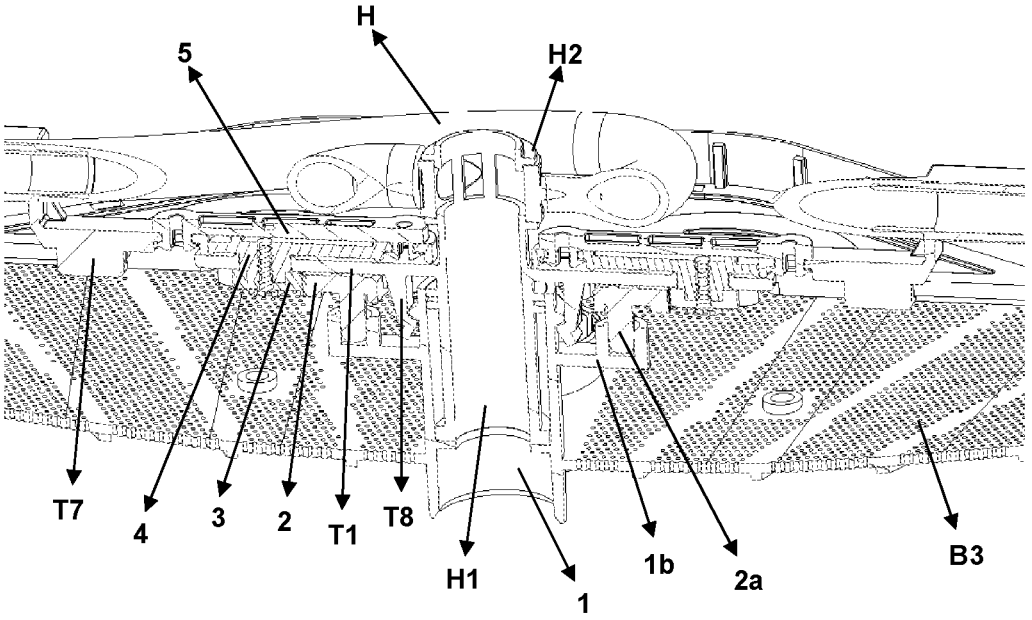
FIG. 9 is a sectional view of the detail "A" in FIG. 4 and detail "D" in FIG. 6.

The parts in the drawings are individually assigned a reference numeral and the equivalents of these numbers are given follow:

Dishwasher (B)
Cleaning chamber (B1)
Base (B2)
Cover (B3)
Sprinkler device (T)
Carrier body (T1)
Fixed arm (T2)
Movable arm (T3)
Upper part (T4)
Guiding member (T5)
Bearing channel (T6)
Bearing member (T7)
First coupling member (T8)
Conveying line (H)
First conveying member (H1)
Second conveying member (H2)
Hole (P)
Fixing member (1)
Body (1*a*)
Retaining part (1*b*)
Fixed gear (2)
Fixing part (2*a*)
Mobile gear (3)
First conveying portion (4)
Second conveying portion (5)
Detail 1 (A)
Detail 2 (D)
First axis (E1)
Second axis (E2)
Third axis (E3)

DESCRIPTION OF THE INVENTION

Dishwashers, which are widely used today for cleaning dishes, comprise a cleaning chamber of a rectangular cross-section in which cleaning processes are carried out. The dishes to be cleaned are placed in the cleaning chamber by means of a basket with a perforated structure. In the cleaning chamber, there is at least one sprinkler device positioned under and/or above the basket and rotates about an axis, preferably in a plane parallel to the bottom of the basket, in order to spray a cleaning fluid onto the dishes in the basket. The sprinkler device rotates about the said axis with the action the fluid sprayed from an angular hole on a spray arm thereof, and with this rotational movement, the cleaning fluid is allowed to reach every possible area in the cleaning chamber. However, due to the rectangular cross-section of the cleaning chamber, cleaning fluid cannot be sprayed sufficiently, especially to the corners, and the dishes positioned close to the corners cannot be cleaned effectively. Known technical implementations addressing the said problem may have various limitations in terms of usage and/or such implementations may cause a serious increase in cost and/or cannot ensure that the dishes are cleaned in a sufficient manner. In this regard, with the present invention, a sprinkler device is provided to solve the said problems.

The sprinkler device (T) according to the present invention, as illustrated in FIGS. 1-11, which is suitable for use in a dishwasher (B) comprising at least one cleaning chamber (B1) in which the dishes are positioned by means of a basket, for spraying a cleaning fluid onto the said dishes by positioning it to rotate about a first axis (E1) (e.g. an axis substantially perpendicular to a base (B2) of the cleaning chamber (B1)) in a plane parallel to the bottom of the basket, comprises at least one carrier body (T1) in the form of a chamber, which is rotatable about the said first axis (E1); at least one fixed arm (T2) which is located on the carrier body (T1), which is fixed relative to the carrier body (T1) and rotatable with the carrier body (T1), which has at least one hole (P) thereon (preferably an angular hole (P)-water jet), and through which the cleaning fluid coming from a fluid line in the dishwasher (B) is sprayed on the dishes through the said hole (P) to thus rotate the carrier body (T1); and at least one movable arm (T3) which is connected with an edge of the carrier body (T1), at least a part of which passes through at least one opening on the said edge of the carrier body (T1) and projects from the carrier body (T1), which has at least one hole (P) thereon (preferably an angular hole (P)-water jet), which allows the carrier body (T1) (and accordingly itself) to rotate about the said first axis (E1) by spraying, through the said hole (P), the cleaning fluid passing therethrough by means of at least one passage opening on its side facing the carrier bod (T1) (e.g. facing center of the carrier body (T1)), which is movable towards the center of the carrier body (T1) (in backward direction) and away from the center (in forward direction), and which can move backward to a closed position, and forward to an open position (in the closed position, a portion of the movable arm (T3) projecting from the said opening is in its shortest length and in the open position, a portion of the movable arm (T3) projecting from the said opening is in its longest length). The sprinkler device (T) also comprises at least one movement mechanism located outside the carrier body (T1), which is triggered and moved by the said rotational movement of the carrier body (T1), thereby enabling said movement of the movable arm (T3), and at least one transmission mechanism, preferably located in the carrier body (T1), which transmits the movement received from the movement mechanism to the movable arm (T3).

Figure 10:
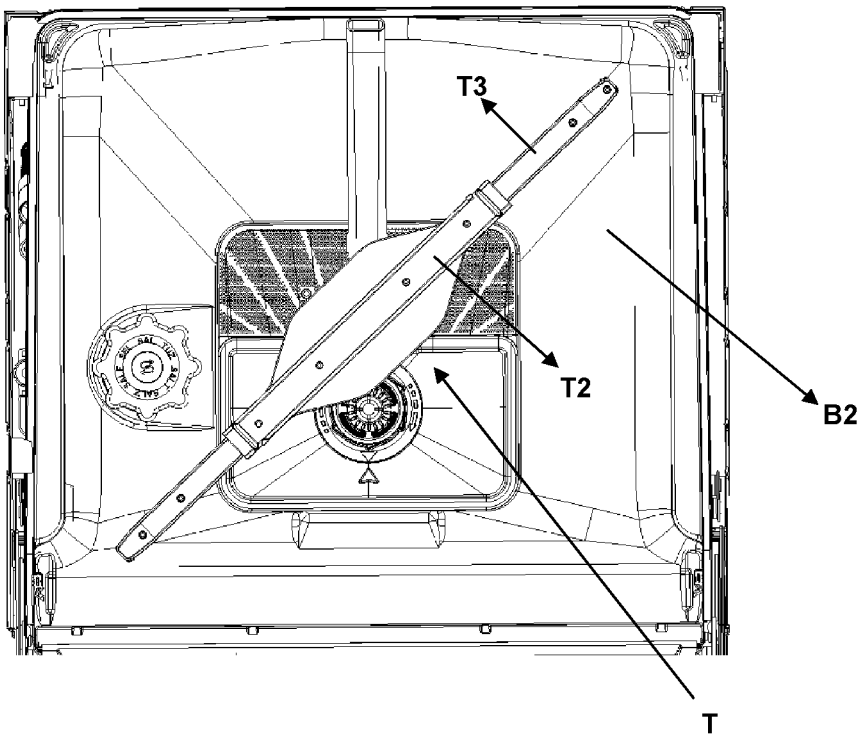
FIG. 10 is a top view of a spray arm of the sprinkler device, showing its position at the corners of the cleaning chamber.
Figure 11:
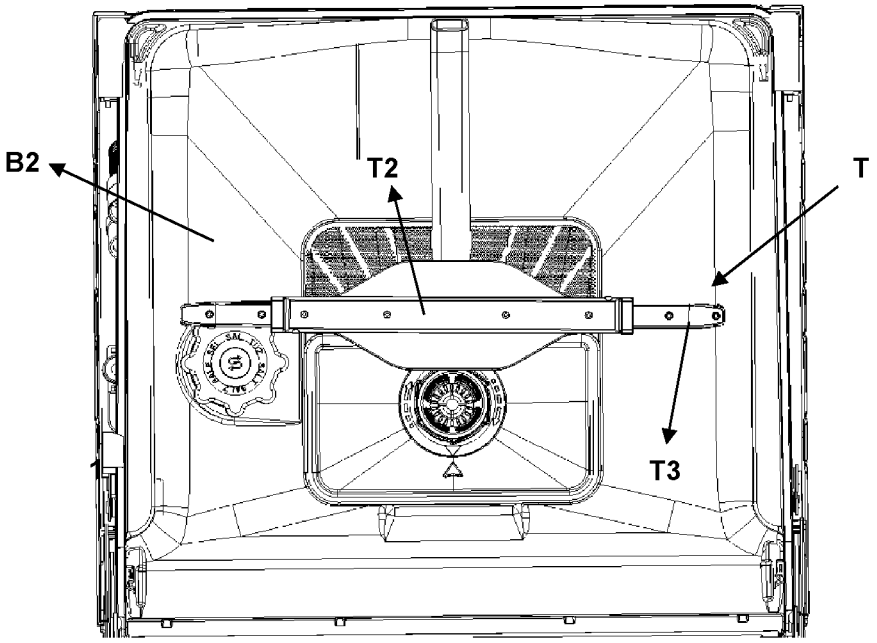
FIG. 11 is a top view of a spray arm of the sprinkler device, showing its position at the sides of the cleaning chamber.

In an exemplary embodiment of the sprinkler device (T) of the present invention, the sprinkler device (T) comprises at least two movable arms (T3) positioned reciprocally, and the carrier body (T1) is preferably mounted to the base (B3) of the cleaning chamber (B2) (especially to an upper cover (B3) enclosing a fluid collection pool at the base (B3)) so as to be rotatable about the said first axis (E1). In the cleaning process to be carried out after the dishwasher (B) is started (for example, during the pre-washing, main washing and/or rinsing), the cleaning fluid taken from a fluid line of the dishwasher (B) into the sprinkler device (T) is transferred to the fixed arm (T2) and the movable arms (T3) and is sprayed towards the dishes located in the cleaning chamber (B1) of the dishwasher (B) through the said holes (P). By spraying the cleaning fluid through the said holes (P), the carrier body (T1) and the fixed arm (T2) and the movable arms (T3), together with the carrier body (T1), rotate about the said first axis (E1). With this rotational movement of the carrier body (T1), the movement mechanism is triggered and moved, and the movement of the movement mechanism is transferred to the movable arms (T3) by means of the said transmission mechanism. The movable arms (T3) rotating about the said first axis (E1) with the transmitted motion of the movement mechanism also move linearly in such a way that they move towards and away from the center of the carrier body (T1). In other words, said movement of the movement mechanism, for example, moves the movable arms (T3), which are in the closed position as shown in FIG. 11, in the forward direction, thereby enabling the movable arms (T3) to take an open position as shown in FIG. 10 (on the contrary, by moving the movable arms (T3) that are in the open position backward, it can also allow the movable arms (T3) to take a closed position). With the said rotational movement of the carrier body (T1), the movable arms (T3) extend as they approach the corners of the cleaning chamber (B1) (a larger portion thereof is enabled to project from the carrier body (T1)) and reach the exact corner area as in FIG. 10 (e.g., once it is positioned to exactly overlap the diagonal of the cleaning chamber (B1)), it comes to the open position in which its protruding portion is the highest. The movable arms (T3), which start to move away from the corner as the carrier body (T1) continues to rotate, move in the reverse direction by means of the movement mechanism and the transmission mechanism, and preferably, when they come to the middle area between two consecutive corners as in FIG. 11, the movable arms (T3) reach the closed position. With the continuation of the said rotational movement of the carrier body (T1), the movable arms (T3) in the closed position start to move forward and take the open position when they are level with another corner. In this way, as the carrier body (1) continues to rotate, the movable arms (T3) also move between the closed/open positions, thus ensuring that the movable arms (T3) have the longest length when aligned with the corners, and the shortest length when aligned with the middle regions of the lateral sides, so that the dishes in the cleaning chamber (B1) of the rectangular cross-section can be cleaned effectively. In addition, the movement of the movable arms (T3) is carried out without using an external energy (e.g., electrical energy) and thus an increase in energy consumption can be prevented. In addition, with the sprinkler device (T), there is no need to use additional equipment that requires extra space in the cleaning chamber (B1) for the movement of the movable arms (T3). Furthermore, due to the fact that the movement mechanism is located outside the carrier body (T1), in case of a failure in the movement mechanism, such failure can be repaired independent from the carrier body (T1), and maintenance and technical service costs can be reduced by changing only the elements in the movement mechanism, when necessary. In addition, due to the fact that the movement mechanism is located outside in such manner, a possible malfunctioning can be determined in advance, and the maintenance and technical service time can be shortened.

In an alternative embodiment of the invention, said movement mechanism preferably comprises at least one fixed gear (2) which is fixed with respect to the carrier body (T1) (i.e., it does not rotate by the rotational movement of the carrier body (T1), and remains fixed), which is positioned outside the carrier body (T1), preferably at a lower side of the carrier body (T1) facing the said base (B2) during the use of the sprinkler device (T) in the dishwasher (B), and at least one (preferably at least one for each movable arm (T3) in case there are a plurality of movable arms (T3)) mobile gear (3) smaller than the fixed gear (2), which is attached to the said carrier body (T1) such that it is rotatable about a second axis (E2) (the second axis (E2) is its own axis that passes substantially through its center) and preferably positioned at the said lower side of the carrier body (T1) during the use of the sprinkler device (T) in the dishwasher (B), which is located outside the carrier body (T1) such that the teeth thereof coincide with the teeth of the said fixed gear (2) and are engaged with the teeth of the said fixed gear (2), which is rotatable about the fixed gear (2) with the said rotational movement of the carrier body (T1), which can also rotate about the second axis (E2), being its own axis, during the said rotational movement, due to the fact that its teeth are engaged with the teeth of the fixed gear (2), and which is connected with the said transmission mechanism, wherein the rotational movements about the fixed gear (2) and the second axis (E2) are transferred to the movable arm (T3) by the said transmission mechanism and the said linear movement of the movable arm (T3) is realized. In this embodiment, the said fixed gear (2) is fixed to a stationary surface (such as the base (B2) of the cleaning chamber (B1)) in the cleaning chamber (B1) during the operation of the dishwasher (B), and the carrier body (T1) is also connected with the fixed gear (2) rotatably about the said first axis (E1). Thus, with the action of the cleaning fluid sprayed from the holes (P), while the carrier body (T1) rotates about the said first axis (E1), the fixed gear (2) does not rotate and remains fixed. However, the mobile gear (3) can rotate along with the carrier body (T1) and can rotate about the fixed gear (2). Due to the fact that the teeth of the mobile gear (3) are engaged with the teeth of the fixed gear (2), the mobile gear (3) also rotates about the second axis (E2) with the rotational movement about the fixed gear (2). Said rotational movements of the mobile gear (3) are transferred to the movable arm (T3) by means of the transmission mechanism, and thus the movable arm (T3) can move linearly in such a way that it moves towards and away from the center of the carrier body (T1); it can take closed/open positions.

With this embodiment, the linear movement of the movable arm (T3) can be performed completely mechanically, and maintenance, technical service costs and times can be reduced, when necessary. In this embodiment, the size of the fixed gear (2) and the mobile gear (3) relative to each other is adjusted so that when the movable arm (T3) reaches precisely the corner of the cleaning chamber (B1), the movable arm (T3) is in the open position where a portion thereof projecting from the carrier body (T1) is the highest; and when the movable arm (T3) reaches precisely the middle region of a side wall of the cleaning chamber (B1), the movable arm (T3) is in the closed position where a portion thereof projecting from the carrier body (T1) is the least. In this embodiment, the transmission mechanism of the sprinkler device (T) also preferably comprises at least one (preferably at least one for each movable arm (T3) in case there are a plurality of movable arms (T3)) first conveying portion (4) in the form of a rod, which is connected at a first side thereof (e.g., a first end) with the mobile gear (3) so as to be rotatable about the said second axis (E2), preferably by means of a first coupling piece such as a screw, and at least one (preferably at least one for each movable arm (T3) in case there are a plurality of movable arms (T3)) second conveying portion (5) in the form of a rod, which is connected at a first side thereof (e.g. a first end) with a second side (e.g. a second end) opposite to the first side of the first conveying portion (4) so as to be rotatable about a third axis (E3) passing therethrough, preferably by means of a second coupling piece such as a lug, and connected rotatably at a second side thereof (e.g. a second end) opposite to the first side with the movable arm (T3), preferably by means of a further second coupling piece. With the rotation of the mobile gear (3) about the second axis (E2), the first conveying portion (4) also rotates about the second axis (E2) and as a result of this rotational movement of the first conveying portion (4), the second conveying portion (5) rotates about the third axis (E3). As a result of the rotational movement of the second conveying portion (5), the movable arm (T3) moves linearly forward or backward and takes an open or closed position. Said second conveying portion (5) is preferably connected with a side of the movable arm (T3) remaining inside the carrier body (T1).

In this embodiment, the sprinkler device (T) also preferably comprises at least one fixing member (1) in the cleaning chamber (B1), which is suitable to be fixed to a surface (such as the base (B2) of the cleaning chamber (B1)) that is stationary during the operation of the dishwasher (B), which is connected at one side with the fixed gear (2), to which the carrier body (T1) is attached by means of at least a first coupling member (T8) (e.g. a lug) so as to be rotatable about the first axis (E1), and through which the cleaning fluid taken from the said fluid line of the dishwasher (B) is transferred to the carrier body (T1). Said fixing member (1) comprises at least a body (1*a*), preferably in the form of a cylinder, which is open at both ends and has a hollow pipe form, and at least one (preferably at least two mutually positioned) retaining part (1*b*), preferably in the form of an arm extending away from the body (1*a*), which is connected to the at least one fixing part (2*a*) provided on the fixed gear (2). The said fixing part (2*a*) is preferably in the form of a pin and there is at least one slot on the said retaining part (1*b*), which is suitable for inserting the pin, preferably by close-fitting. In another embodiment, said fixing part (2*a*) can be in the form a housing and the retaining part (1*b*) can have a pin that is preferably attached to the housing by close-fitting. In another embodiment, the connection between the fixing member (1) and the movement mechanism can also be provided by tab structures.

In another preferred embodiment, the transmission mechanism of the sprinkler device (T) comprises at least one (preferably at least one for each movable arm (T3) in case there are a plurality of movable arms (T3)) first conveying portion (4) in the form of a rod, which is connected at a first side thereof (e.g., a first end) with the movement mechanism so as to be rotatable about a second axis (E2), preferably by means of a first coupling piece such as a screw, and at least one (preferably at least one for each movable arm (T3) in case there are a plurality of movable arms (T3)) second conveying portion (5) in the form of a rod, which is connected at a first side thereof (e.g. a first end) with a second side (e.g. a second end) opposite to the first side of the first conveying portion (4) so as to be rotatable about a third axis (E3) passing therethrough, preferably by means of a second coupling piece such as a lug, and connected rotatably at a second side thereof (e.g. a second end) opposite to the first side with the movable arm (T3), preferably by means of a further second coupling piece. With the triggered movement of the movement mechanism, the first conveying portion (4) rotates about the second axis (E2) and as a result of this rotational movement of the first conveying portion (4), the second conveying portion (5) rotates about the third axis (E3). As a result of the rotational movement of the second conveying portion (5), the movable arm (T3) moves linearly forward or backward and takes an open or closed position. Said second conveying portion (5) is preferably connected with a side of the movable arm (T3) remaining inside the carrier body (T1).

In another embodiment of the present invention, the sprinkler device (T) preferably comprises at least a first conveying member (H1), preferably in the form of a cylinder, having a pipe structure with two open ends, which is positioned on the carrier body (T1) such that one of the open ends thereof is outside the carrier body (T1) and the other one is in the carrier body (T1), an end of which that is located outside the carrier body (T1) is preferably at a lower side of the carrier body (T1) facing the said base (B2) during the use of the sprinkler device (T) in the dishwasher (B), through which the cleaning fluid is passed into the carrier body (T1), and which is preferably rotatable about the said first axis (E1) together with the carrier body (T1). Said first conveying member (H1) is connected at its end outside the carrier body (T1) with the fluid line in the dishwasher (B), and ensures that the cleaning fluid coming from the fluid line passes through the carrier body (T1) and into the fixed arm (T2) and the movable arm (T3). In this embodiment, the sprinkler device (T) also preferably comprises at least a second conveying member (H2) having at least one fluid inlet connected with the first conveying member (H1), at least one (preferably at least one for each movable arm (T3) in case there are a plurality of movable arms (T3)) first fluid outlet connected with the movable arm (T3), and at least one second fluid outlet connected with the fixed arm (T2), which is connected with the first conveying member (H1) such that it is preferably rotatable about the first conveying member (H1) with respect to the first conveying member (H1) and to enclose preferably at least a part of the first conveying member (H1) (i.e., into which the end of the first conveying member (H1) remaining in the carrier body (T1) is inserted through the fluid inlet), and at least one conveying line (H) (e.g. a hose) which is connected at one side with the first fluid outlet and at the other side with the movable arm (T3), which allows the cleaning fluid which is passed through the first conveying member (H1) and into the carrier body (T1) to pass therethrough by means of the second conveying member (H2) to reach the movable arm (T3), which has a flexible form (i.e. which can be bent/twisted, but does not change in length) and which is preferably located in the carrier body (T1). Since the movement of the movable arm (T3) is provided by the rotational movement of the carrier body (T1) (i.e., it is provided by the pushing force of the fluid sprayed from the angular hole (P) and rotating the carrier body (T1)), when the movable arm (T3) takes the longest length, i.e., in the open position, in order for the carrier body (T1) to continue to rotate, the volume of the sprinkler device (T) must be reduced by overcoming the pressure in the movable arm (T3) and the conveying line (H) and moving the movable arm (T3) backwards. Thus, a great force is required for this movement, and the rotational force of the fluid ejected from the angular holes (P) may not be sufficient to overcome said pressure, since the fluid pressure in the sprinkler device (T) is greater than the force generating a rotational force that is ejected from the holes (P). For this reason, the movable arm (T3) can reach the longest position and get stuck in this position and therefore the carrier body (T1) cannot continue to rotate. In order to solve the said problem, in the sprinkler device (T) of the present invention, a conveying line (H) which has a flexible form and a sufficient length is used so as not to prevent the movement of the movable arm (T3), and the cleaning fluid received through the said first conveying member (H1) is transmitted to the mobile arm (T3) via the conveying line (6) that does not change in volume. In this way, the parts in the sprinkler device (T) where the fluid delivery is carried out have a fixed volume (i.e., the volume of the parts filled with cleaning fluid does not change) and therefore the problem of being stuck therein can be avoided. In addition, by the use of the second conveying member (H2) with multiple outlets, the cleaning fluid is allowed to reach both the fixed arm (T2) and the movable arm (T3) equally and homogeneously, and both the operation and the cleaning performance of the sprinkler device (T) can be increased. In this embodiment, the sprinkler device (T) preferably comprise at least one fixing member (1) in the cleaning chamber (B1), which is suitable to be fixed to a surface (such as the base (B2) of the cleaning chamber (B1)) that is stationary during the operation of the dishwasher (B), which is connected at one side with the movement mechanism, to which the carrier body (T1) is attached by means of at least a first coupling member (T8) (e.g. a lug) so as to be rotatable about the first axis (E1), to which an end of the first conveying member (H1) that is located outside the carrier body (T1) is attached (into which a side of the first conveying member (H1) that is located outside the carrier body (T1) is preferably inserted), and through which the cleaning fluid taken from the said fluid line of the dishwasher (B) is transferred to the first conveying member (H1). Said fixing member (1) comprises at least a body (1*a*), preferably in the form of a cylinder, which is open at both ends and has a hollow pipe form, and to which an end of the first conveying member (H1) that is located outside the carrier body (T1) is attached (into which a side of the first conveying member (H1) that is located outside the carrier body (T1) is preferably inserted), and at least one (preferably at least two mutually positioned) retaining part (1*b*), preferably in the form of an arm extending away from the body (1*a*), which is connected to the at least one fixing part (2*a*) provided on the movement mechanism. The said fixing part (2*a*) is preferably in the form of a pin and there is at least one slot on the said retaining part (1*b*), which is suitable for inserting the pin, preferably by close-fitting. In another embodiment, said fixing part (2*a*) can be in the form a housing and the retaining part (1*b*) can have a pin that is preferably attached to the housing by close-fitting. In another embodiment, the connection between the fixing member (1) and the movement mechanism can also be provided by tab structures.

In an alternative embodiment of the invention, the sprinkler device (T) preferably comprises at least an upper part (T4) located on the said fixed arm (T2), which is closed on the carrier body (T1) and thus forms a closed chamber structure with the carrier body (1). Thus, an unintentional detachment of the components (e.g., conveying line (H), second conveying member (H2), first conveying member (H1), transmission mechanism, etc.) in the carrier body (T1) can be avoided during the movement, and they are prevented from moving away from the carrier body (T1). In this embodiment, the fixed arm (T2) can either be an external part attached to the upper part (T4), or it can also be integrated with the upper part (T4). Therefore, some of the cleaning fluid taken into the carrier body (T1) can be directly supplied into the fixed arm (T2) or filled into the carrier body (T1) and transferred to the fixed arm (T2) therefrom. For example, in an embodiment wherein the fixed arm (T2) and the upper part (T4) are integrated, the upper part (T4) can function as the fixed arm (T2), in which case, the cleaning fluid is directly filled into the carrier body (T1) and allowed to reach the holes (P) in the fixed arm (T2). In other embodiments wherein the fixed arm (T2) and the upper part (T4) are integrated (or wherein the fixed arm (T2) is attached to the upper part (T4)), the fixed arm (T2) can be in the form of a closed channel on the upper part (T4) and there may be openings in the upper part (T4) and the fixed arm (T2), in order to allow the cleaning fluid to enter the fixed arm (T2).

In another exemplary embodiment, the sprinkler device (T) preferably comprises at least one fixing member (1) in the cleaning chamber (B1), which is suitable to be fixed to a surface (such as the base (B2) of the cleaning chamber (B1)) that is stationary during the operation of the dishwasher (B), which is connected at one side with the movement mechanism, to which the carrier body (T1) is attached by means of at least a first coupling member (T8) (e.g. a lug) so as to be rotatable about the first axis (E1), and through which the cleaning fluid taken from the said fluid line of the dishwasher (B) is transferred to the carrier body (T1). Said fixing member (1) comprises at least a body (1*a*), preferably in the form of a cylinder, which is open at both ends and has a hollow pipe form, and at least one (preferably at least two mutually positioned) retaining part (1*b*), preferably in the form of an arm extending away from the body (1*a*), which is connected to the at least one fixing part (2*a*) provided on the movement mechanism. The said fixing part (2*a*) is preferably in the form of a pin and there is at least one slot on the said retaining part (1*b*), which is suitable for inserting the pin, preferably by close-fitting. In another embodiment, said fixing part (2*a*) can be in the form a housing and the retaining part (1*b*) can have a pin that is preferably attached to the housing by close-fitting. In another embodiment, the connection between the fixing member (1) and the movement mechanism can also be provided by tab structures.

In an alternative embodiment of the invention, the sprinkler device (T) also preferably comprises at least one bearing member (T7) in the form of a protrusion extending towards the carrier body (T1), which is located at a lower side of the movable arm (T3) such that it is on a side of the movable arm (T3) facing the center of the carrier body (T1), and at least one bearing channel (T6) located at the base of the carrier body (T1), which is extended in the direction of the movement of the movable arm (T3), in which the bearing member (T7) is located and slides therein with the movement of the movable arm (T3). With the bearing member (T7) and the bearing channel (T6), the movable arm (T3) is allowed to move smoothly in a certain direction and the sprinkler device (T) can be operated correctly by preventing an unwanted movement. In addition, the movement of the movable arm (T3) can be determined according to the needs by the length of the bearing channel (T6).

In another embodiment, the sprinkler device (T) preferably comprises at least one guiding member (T5) guiding the movement of the movable arm (T3) in the forward and backward direction, which is located at an edge where the movable arm (T3) is connected with the carrier body (T1), and which forms an arch on the movable arm (T3) such that it passes through at least a part of the movable arm (T3) and extends to the center of the carrier body (T1).

With the sprinkler device (T) of the present invention, the cleaning fluid can be effectively supplied to a large part of the interior volume of the cleaning chamber (B1), and the dishes can be cleaned more effectively and more efficiently. In addition, the movable arm (T3), which can be lengthened and shortened, is moved without using external energy such as electricity, and with the positioning of the movement mechanism that performs this movement outside the carrier body (T1), costs can be reduced along with the maintenance and technical service times. Thus, a sprinkler device can be obtained which has a low production cost, is easy to use, practical and reliable.

The invention claimed is:

1. A sprinkler device (T) which is suitable for use in a dishwasher (B) wherein at least one cleaning chamber (B1) in which the dishes are positioned by means of a basket, for spraying a cleaning fluid onto the said dishes by positioning it to rotate about a first axis (E1) in a plane parallel to the bottom of the basket, wherein:

at least one carrier body (T1) in the form of a chamber, which is rotatable about the said first axis (E1);

at least one fixed arm (T2) which is located on the carrier body (T1), which is fixed relative to the carrier body (T1) and rotatable with the carrier body (T1), which has at least one hole (P) thereon, and through which the cleaning fluid coming from a fluid line in the dishwasher (B) is sprayed on the dishes through the said hole (P) to thus rotate the carrier body (T1);

at least one movable arm (T3) which is connected with an edge of the carrier body (T1), at least a part of which passes through at least one opening on the said edge of the carrier body (T1) and projects from the carrier body (T1), which has at least one hole (P) thereon, which allows the carrier body (T1) to rotate about the said first axis (E1) by spraying, through the said hole (P), the cleaning fluid passing therethrough by means of at least one passage opening on its side facing the carrier bod (T1), which is movable towards the center of the carrier body (T1) and away from the center to thus take a closed position and an open position, wherein:

at least one movement mechanism located outside the carrier body (T1), which is triggered and moved by the said rotational movement of the carrier body (T1), thereby enabling said movement of the movable arm (T3), and at least one transmission mechanism which transmits the movement received from the movement mechanism to the movable arm (T3).

2. A sprinkler device (T) according to claim 1, wherein said transmission mechanism is located in the carrier body (T1).

3. A sprinkler device (T) according to claim 1, wherein said movement mechanism comprises at least one fixed gear (2) which is fixed with respect to the carrier body (T1) and positioned outside the carrier body (T1), and at least one mobile gear (3) smaller than the fixed gear (2), which is attached to the said carrier body (T1) such that it is rotatable about a second axis (E2), which is located outside the carrier body (T1) such that the teeth thereof coincide with the teeth of the said fixed gear (2) and are engaged with the teeth of the fixed gear (2), which is rotatable about the fixed gear (2) with the said rotational movement of the carrier body (T1), which can also rotate about the second axis (E2), being its own axis, during the said rotational movement, due to the fact that its teeth are engaged with the teeth of the fixed gear (2), and which is connected with the said transmission mechanism, wherein the rotational movements about the fixed gear (2) and the second axis (E2) are transferred to the movable arm (T3) by the said transmission mechanism and the said linear movement of the movable arm (T3) is realized.

4. A sprinkler device (T) according to claim 3, wherein the size of the fixed gear (2) and the mobile gear (3) relative to each other is adjusted so that when the movable arm (T3) reaches precisely the corner of the cleaning chamber (B1), the movable arm (T3) is in the open position where a portion thereof projecting from the carrier body (T1) is the highest; and when the movable arm (T3) reaches precisely the middle region of a side wall of the cleaning chamber (B1), the movable arm (T3) is in the closed position where a portion thereof projecting from the carrier body (T1) is the least.

5. A sprinkler device (T) according to claim 3 wherein the transmission mechanism comprises at least one first conveying portion (4) in the form of a rod, which is connected at a first side thereof with the fixed gear (3) so as to be rotatable about the second axis (E2), and at least one second conveying portion (5) in the form of a rod, which is connected at a first side thereof with a second side opposite to the first side of the first conveying portion (4) so as to be rotatable about a third axis (E3) passing therethrough, and connected rotatably at a second side thereof opposite to the first side with a side of the movable arm (T3) remaining in the carrier body (T1).

6. A sprinkler device (T) according to claim 3, wherein at least one fixing member (1) in the cleaning chamber (B1), which is suitable to be fixed to a surface that is stationary during the operation of the dishwasher (B), which is connected at one side with the fixed gear (2), to which the carrier body (T1) is attached by means of at least a first coupling member (T8) so as to be rotatable about the first axis (E1), and through which the cleaning fluid taken from the said fluid line of the dishwasher (B) is transferred to the carrier body (T1).

7. A sprinkler device (T) according to claim 6, wherein said fixing member (1) comprises at least a body (1*a*) which is open at both ends and has a hollow pipe form, and at least one retaining part (1*b*) which is connected to the at least one fixing part (2*a*) provided on the fixed gear (2).

8. A sprinkler device (T) according to claim 1, wherein said transmission mechanism comprises at least one first conveying portion (4) in the form of a rod, which is connected at a first side thereof with the movement mechanism so as to be rotatable about a second axis (E2), and at least one second conveying portion (5) in the form of a rod, which is connected at a first side thereof with a second side opposite to the first side of the first conveying portion (4) so as to be rotatable about a third axis (E3) passing therethrough, and connected rotatably at a second side thereof opposite to the first side with a side of the movable arm (T3) remaining in the carrier body (T1).

9. A sprinkler device (T) according to claim 1, wherein at least a first conveying member (H1) having a pipe structure with two open ends, which is positioned on the carrier body (T1) such that one of the open ends thereof is outside the carrier body (T1) and the other one is in the carrier body (T1), an end of which that is located outside the carrier body (T1) is at a lower side of the carrier body (T1) facing the said base (B2) during the use of the sprinkler device (T) in the dishwasher (B), and through which the cleaning fluid is passed into the carrier body (T1).

10. A sprinkler device (T) according to claim 9, wherein at least one second conveying member (H2) having at least one fluid inlet connected with the first conveying member (H1), at least one first fluid outlet connected with the movable arm (T3), and at least one second fluid outlet connected with the fixed arm (T2), which is connected with the first conveying member (H1) such that it is rotatable with respect to the first conveying member (H1), and at least one conveying line (H) being a flexible hose, which is connected at one side with the first fluid outlet and at the other side with the movable arm (T3), which allows the cleaning fluid which is passed through the first conveying member (H1) and into the carrier body (T1) to pass therethrough by means of the second conveying member (H2) to reach the movable arm (T3).

11. A sprinkler device (T) according to claim 9, wherein at least one fixing member (1) in the cleaning chamber (B1), including at least one body (1*a*) which is suitable to be fixed to a surface that is stationary during the operation of the dishwasher (B), which is connected at one side with the movement mechanism, to which the carrier body (T1) is attached by means of at least a first coupling member (T8) so as to be rotatable about the first axis (E1), to which an end of the first conveying member (H1) remaining outside the carrier body (T1) is connected, through which the cleaning fluid taken from the said fluid line of the dishwasher (B) is transferred to the first conveying member (H1), which is open at both ends and has a hollow pipe form, and to which an end of the first conveying member (H1) remaining outside the carrier body (T1) is connected, and at least one retaining part (1*b*) which is connected to the at least one fixing part (2*a*) provided on the movement mechanism.

12. A sprinkler device (T) according to claim 1, wherein at least one fixing member (1) in the cleaning chamber (B1), including at least one body (1*a*) which is suitable to be fixed to a surface that is stationary during the operation of the dishwasher (B), which is connected at one side with the movement mechanism, to which the carrier body (T1) is attached by means of at least a first coupling member (T8) so as to be rotatable about the first axis (E1), through which the cleaning fluid taken from the said fluid line of the dishwasher (B) is transferred to carrier body (T1), which is open at both ends and has a hollow pipe form, and at least one retaining part (1*b*) which is connected to the at least one fixing part (2*a*) provided on the movement mechanism.

13. A sprinkler device (T) according to claim 1, wherein comprising at least an upper part (T4) located on the said fixed arm (T2), which is closed on the carrier body (T1) and thus forms a closed chamber structure with the carrier body (1).

14. A sprinkler device (T) according to claim 1, wherein at least one bearing member (T7) in the form of a protrusion extending towards the carrier body (T1), which is located at a lower side of the movable arm (T3) such that it is on a side of the movable arm (T3) facing the center of the carrier body (T1), and at least one bearing channel (T6) located at the base of the carrier body (T1), which is extended in the direction of the movement of the movable arm (T3), in which the bearing member (T7) is located and slides therein with the movement of the movable arm (T3).

15. A sprinkler device (T) according to claim 1, wherein at least one guiding member (T5) guiding the movement of the movable arm (T3) in the forward and backward direction, which is located at an edge where the movable arm (T3) is connected with the carrier body (T1), and which forms an arch on the movable arm (T3) such that it passes through at least a part of the movable arm (T3) and extends to the center of the carrier body (T1).

* * * * *